US007959335B1

(12) United States Patent
Hopkins

(10) Patent No.: US 7,959,335 B1
(45) Date of Patent: Jun. 14, 2011

(54) PORTABLE FISHING LIGHT

(76) Inventor: Timothy Nevin Hopkins, Lebanon, TN (US)

( * ) Notice: Subject to any disclaimer, the term of this patent is extended or adjusted under 35 U.S.C. 154(b) by 87 days.

(21) Appl. No.: 12/464,651

(22) Filed: May 12, 2009

Related U.S. Application Data

(60) Provisional application No. 61/052,477, filed on May 12, 2008.

(51) Int. Cl.
*B63B 45/06* (2006.01)

(52) U.S. Cl. ... 362/477; 362/230; 362/231; 362/249.02; 362/249.07

(58) Field of Classification Search ..... 362/167, 362/177, 230, 231, 249.02, 249.03, 249.11, 362/370, 371, 389, 190
See application file for complete search history.

(56) References Cited

U.S. PATENT DOCUMENTS

| | | | | |
|---|---|---|---|---|
| 3,838,267 | A | 9/1974 | Eggers et al. | |
| 5,175,437 | A | 12/1992 | Waluszko | |
| 5,339,225 | A | 8/1994 | Wiggerman | |
| 5,491,621 | A | 2/1996 | Duty | |
| 5,504,342 | A | 4/1996 | Jaynes | |
| 6,174,078 | B1 | 1/2001 | Ohm et al. | |
| D458,339 | S | 6/2002 | Cheong | |
| 6,474,851 | B1 | 11/2002 | Baley | |
| 6,644,829 | B1 | 11/2003 | Tracy et al. | |
| 7,192,160 | B2 * | 3/2007 | Reiff et al. | 362/231 |
| 7,246,920 | B1 * | 7/2007 | Hopkins | 362/287 |
| 7,731,379 | B2 * | 6/2010 | Wakalopulos | 362/109 |

* cited by examiner

*Primary Examiner* — Anabel M Ton
(74) *Attorney, Agent, or Firm* — Eric K. Karich

(57) ABSTRACT

A portable fishing light has a base housing, a mounting element adapted for removably mounting the base housing on the boat, and a light wand having a white light source and a UV light source. A flexible control arm adjustably mounts the light wand to the base housing so that the light wand can be adjustably positioned relative to the base housing.

15 Claims, 2 Drawing Sheets

PORTABLE FISHING LIGHT

CROSS-REFERENCE TO RELATED APPLICATIONS

This application for a utility patent claims the benefit of U.S. Provisional Application No. 61/052,477, filed May 12, 2008.

BACKGROUND OF THE INVENTION

1. Field of the Invention

This invention relates generally to portable lights, and more particularly to a portable fishing light that includes both a white light source and a UV light source mounted on opposing surfaces of an adjustable light wand.

2. Description of Related Art

The prior art teaches a variety of lighting system for use by fishermen during night fishing. Ohm et al., U.S. Pat. No. 6,174,078, for example, teaches a boat light system that includes a navigation light mounted on an elongate transparent housing. The housing includes, at its top, a black light, and at its bottom, a white light. The black and white lights are mounted coaxially, one above the other. The bottom of the housing includes an electrical plug for electrically connecting the system to an electrical power supply.

Wiggerman, U.S. Pat. No. 5,339,225, describes a navigation light that includes an illuminated elongate base specifically intended as a boat stern running light. The base includes at least one light source positioned adjacent either the bottom end, and adapted to emit light upwardly, or positioned adjacent the top end and adapted to emit light in a downward direction, to illuminate the base. The base includes a smooth outer wall and an inner wall provided with a light diffractive surface. Light emitted from either the upper or lower light source will be diffracted along the inner wall of the elongated wand thereby to illuminate the entire length of the wand.

Tracy et al., U.S. Pat. No. 6,644,829, describes a horizontal light device that is adapted to be mounted to a fishing boat for providing light as desired by a fisherman. The horizontal light device includes a pair of light bulbs (black and white), and is pivotally mounted so that the bulbs housing can rotate with respect to the bracket 360 degrees about an axis. Alternate and replaceable fastening mechanisms are provided extending from the pivot bracket with the fastening mechanisms being detachable from the bracket.

Baley, U.S. Pat. No. 6,474,851, describes a fishing lighting system that includes an ultraviolet light source and a white light source integrally built into the gunwale of a fishing boat. The system includes a controller for controlling the ultraviolet light source and the white light source and a mounting base.

Jaynes et al., U.S. Pat. No. 5,504,342, describes a handrail that is equipped with an ultraviolet bulb and is useful as an accessory in night time fishing. The handrail may be permanently mounted on the deck of a fishing vessel, and is constructed so that the ultraviolet bulb faces outward from the hull of the boat and causes fluorescent fishing line disposed in the immediate vicinity of the hull to fluoresce. The handrail is provided with fastener for directing the orientation of the bulb, and is also provided with a protective cover that is substantially transparent to ultraviolet light and that protects the bulb from the elements.

Eggers et al., U.S. Pat. No. 3,838,267, describes a light for night fishing. The light primarily consists of a suction cup mounted on a plastic box having a removable lens secured to the open end from which light is emitted from a snapable releasable bulb, the device including a brightness control, an on and off switch, and inpower supply or to an automobile battery.

Waluszko, U.S. Pat. No. 5,175,437, describes an apparatus for irradiating an object such as a specimen of material with ultraviolet radiation at a selected long, short or mid-wave length. The apparatus of the invention includes a plurality of ultraviolet sources, each emitting radiation at a different wave length. The sources are mounted within a rotatable array so that a selected one of the sources can be sequentially moved into alignment with the specimen and then automatically energized by merely rotating the array.

Duty, U.S. Pat. No. 5,491,621, describes a work light including a pair of suction base members for supporting the light on a surface adjacent to a work area. An arcuate arm extends from each of the base members and a fluorescent light is supported at an end of the arms distal from the base members. The arms may be pivoted relative to the base members in order to position the light at a desired location relative to the work area.

Cheong, U.S. Pat. No. D458,339, shows a design for a fishing light that is elongate and appears to have a single bulb, although no structural features are described.

The above-described references are hereby incorporated by reference in full.

The prior art teaches various lighting devices that include both UV (black) lights and white lights for assisting fishermen engaged in night fishing. However, the prior art does not teach a portable fishing light that includes both a white light source and a UV light source mounted on opposing surfaces of a light wand that is mounted on a flexible control arm so that white light may be directed into a vessel for use by a fisherman, and UV light may be directed outboard for illuminating fishing lines. The present invention fulfills these needs and provides further related advantages as described in the following summary.

SUMMARY OF THE INVENTION

The present invention teaches certain benefits in construction and use which give rise to the objectives described below.

The present invention provides a portable fishing light for use on a boat. The portable fishing light comprises a base housing; a mounting element adapted for removably mounting the base housing on the boat; a light wand having a white light source and a UV light source; and a flexible control arm adjustably mounting the light wand to the base housing so that the light wand can be adjustably positioned relative to the base housing.

A primary objective of the present invention is to provide a portable fishing light having advantages not taught by the prior art.

Another objective is to provide a portable fishing light that includes both a white light source and a UV light source mounted on opposing surfaces of a light wand that is mounted on a flexible control arm so that white light may be directed into a vessel for use by a fisherman, and UV light may be directed outboard for illuminating fishing lines.

Another objective is to provide a portable fishing light wherein the light wand may be easily adjusted between a stowed position for storage, and an extended position for use.

A further objective is to provide a portable fishing light that is easily portable for shipping and storage, and includes a mounting element that enables the portable fishing light to be quickly and easily mounted on a boat or other vehicle or vessel.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a portable fishing light 10 for use on a boat 12 or other vehicle. The portable fishing light 10 includes both a UV light source 42 and a white light source 44. The portable fishing light 10 is particularly useful for night fishing because it directs UV light outwardly for illuminating fishing line, while directing white light inwardly for assisting the fisherman with tasks on the boat 12 (e.g., baiting a hook, removing a hook from a fish's mouth, etc.).

Figure 1:
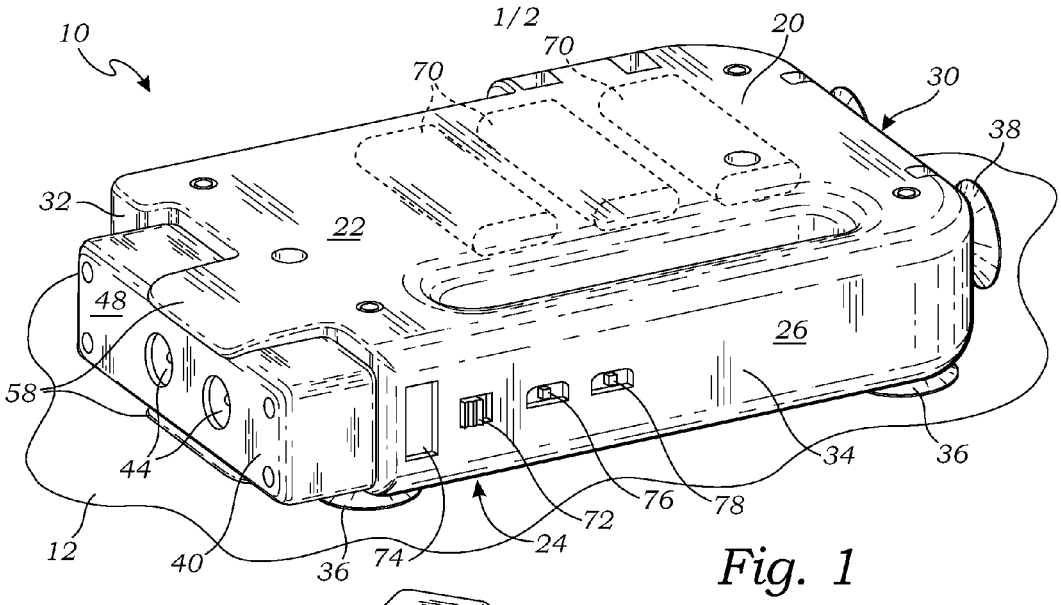
FIG. 1 is a front perspective view of a portable fishing light according to one embodiment of the present invention, the portable fishing light having a light wand in a stowed position on the base housing.
Figure 2:
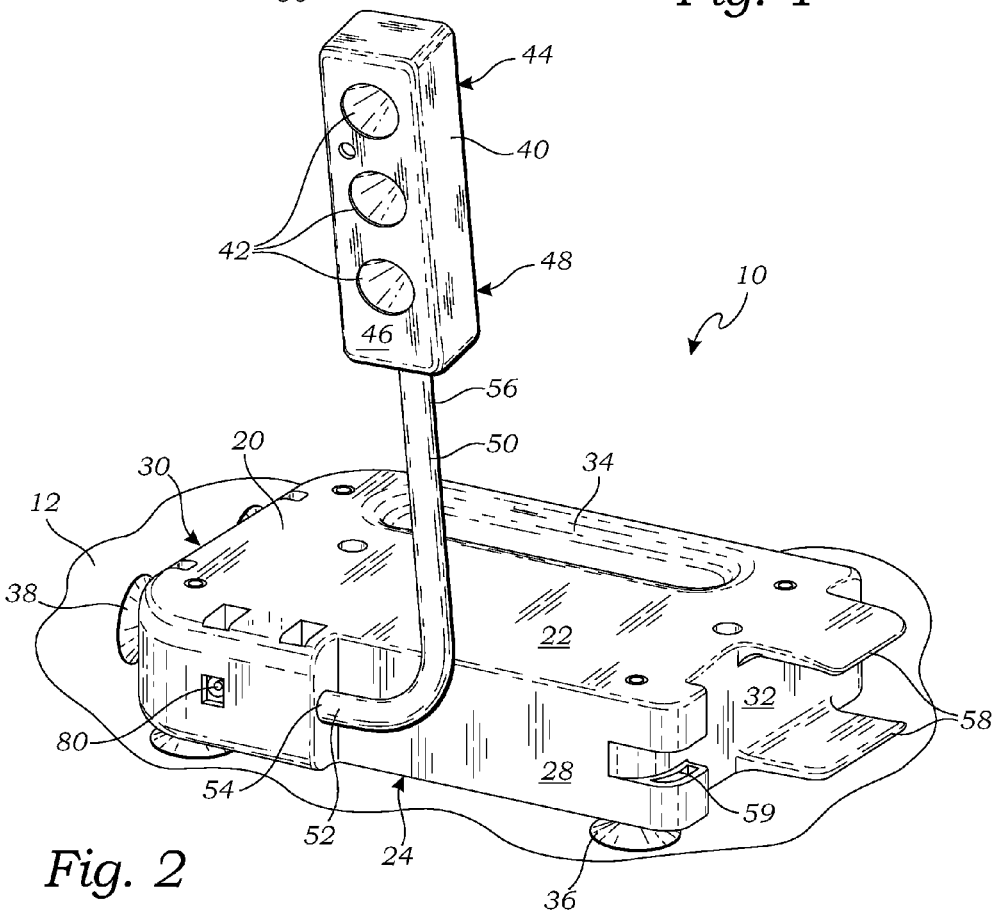
FIG. 2 is rear perspective view thereof, illustrating the light wand in an extended position.

FIG. 1 is a front perspective view of the portable fishing light 10 illustrating a light wand 40 in a stowed position on a base housing 20. FIG. 2 is rear perspective view thereof, illustrating the light wand 40 in an extended position. As illustrated in FIGS. 1 and 2, a flexible control arm 50 of the portable fishing light 10 enables a light wand 40 to be removed from a base housing 20 of the portable fishing light 10, and positioned in almost any position so that the white light and UV light are both directed where desired.

As illustrated in FIGS. 1 and 2, the base housing 20 may be a generally rectangular housing having opposed top and bottom surfaces 22 and 24, opposed front and rear surfaces 26 and 28, and opposed left and right side surfaces 30 and 32. The top surface 22 may be spaced from the bottom surface 24 to receive a battery 60 (or batteries) there between. The top and bottom surfaces 22 and 24 may further include an aperture 54 there through for forming a handle 34 for carrying the portable fishing light 10. The handle 34 may be molded into the base housing 20, as illustrated, or may be formed in other ways known in the art. The base housing 20 may be constructed of a rigid, lightweight material (e.g., plastic) using methods well known in the art. Alternatively, the base housing 20 may be formed of stronger, heavier materials (e.g., aluminum, steel, etc.) if a stronger and more expensive version is desired. Those skilled in the art may devise alternative embodiments, and such alternatives should be considered within the scope of the present invention.

As illustrated in FIG. 1, the portable fishing light 10 may further include a pair of locking arms 58 extending from the base housing 20. The pair of locking arms 58 are adapted to receive the light wand 40 there between and frictionally engage the light wand 40 to hold the light wand 40 in the stowed position. The portable fishing light 10 may further include a corner groove 59 integrally molded into the base housing 20, and shaped to receive the flexible control arm 50 therein. When the light wand 40 is clamped or otherwise held between the pair of locking arms 58, the flexible control arm 50 is locked in the corner groove 59, thereby keeping the flexible control arm 50 in place and helping to protect it from damage. When the light wand 40 is removed from between the pair of locking arms 58, the flexible control arm 50 comes out of the corner groove 59, freeing the entire length of the flexible control arm 50 for use in positioning the light wand 40.

The base housing 20 includes a mounting element 36 for removably mounting the base housing 20 on the boat 12. In the embodiment of FIGS. 1 and 2, the mounting element 36 includes a suction cup (or set of suction cups). The suction cups 36 may be mounted, for example, on the bottom surface 24. In another embodiment, a second suction cup 36 (or set of suction cups) may also be attached to the left side surface 30 (or a similar surface or surfaces) to enable the base housing 20 to be removably mounted to the boat 12 in different orientations. The mounting element 36 may also utilize alternative attachment mechanisms, such as hooks and loops fasteners (e.g., Velcro®), magnets, adhesives, and/or other elements known in the art.

As illustrated in FIGS. 1 and 2, the light wand 40 is a housing adapted to hold the UV light source 42 (e.g., three UV LEDs) and the white light source 44 (e.g., two white LEDs). Obviously, many different light sources may be used to generate the UV light and/or the white light, including different numbers of LEDs, depending on the intensities of the LEDs used.

In one embodiment, the light wand 40 is a generally rectangular housing that includes opposing surfaces 46 and 48, with the UV LEDs 64 mounted on one of the surfaces, and the white LEDs 66 mounted on the other of the surfaces. The opposing sides enable the white light from the white light source 44 and the UV light from the UV light source 42 to be projected in opposing directions (e.g., 180 degrees from each other, or similarly different angles).

As illustrated in FIGS. 1 and 2, the flexible control arm 50 adjustably mounts the light wand 40 to the base housing 20 so that the light wand 40 can be adjustably positioned relative to the base housing 20. In one embodiment, the flexible control arm 50 is constructed of a pliant, bendable material and/or conduit that enables the light wand 40 to be easily bent or otherwise moved and positioned with respect to the base housing 20. The flexible control arm 50 may include a flexible conduit that can bend to a desired position and then maintain that position while upholding the light wand 40 thereupon. The flexible control arm 50 may alternatively be constructed at a plurality of ball and socket joints such as is disclosed in Lockwood, U.S. Pat. No. 5,449,206, or a similar tube such as disclosed in Price et al., U.S. Pat. No. 5,823,657, both of which are hereby incorporated by reference in full.

In the embodiment of FIGS. 1 and 2, a proximal end 52 of the flexible control arm 50 is slightly positioned through an aperture 54 of a rear surface 28 of the base housing 20, and to distal end 56 of the flexible control arm 50 is attached to the light wand 40. The base housing 20 further includes a pair of opposed, resilient locking arms 58 extending from the right side surface 32 of the base housing 20. A corner groove 59 is shaped to receive the flexible control arm 50.

As illustrated in FIG. 1, in a stowed position the light wand 40 may be clamped between the resilient locking arms 58 and the flexible control arm 50 may be received into the corner groove 59 (best illustrated in FIG. 2). In a stowed position, the portable fishing light 10 may be easily stored, and the light wand 40 and the flexible control arm 50 are held closely against and protected by the base housing 20.

As illustrated in FIG. 2, in the extended position the flexible control arm 50 is moved clear of the corner groove 59 so that the light wand 40 may be located in any position and orientation that may be desired by the user.

Figure 3:
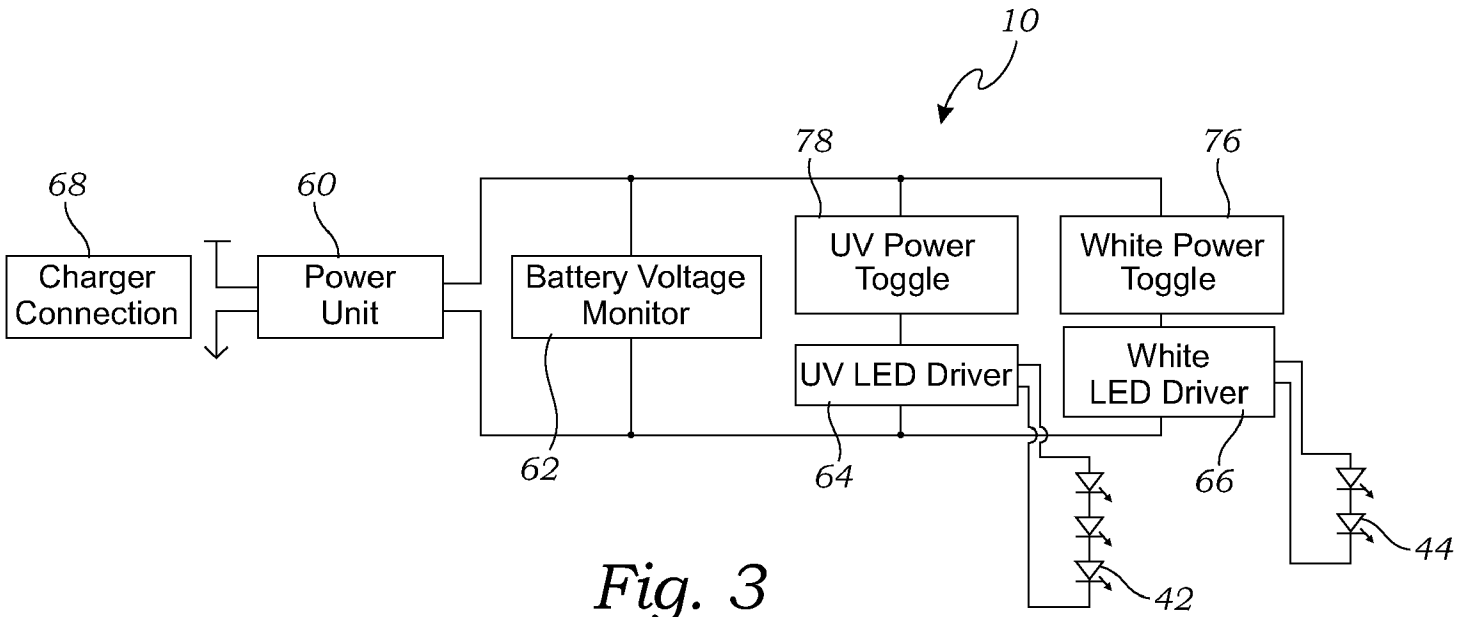
FIG. 3 is a block diagram thereof.

FIG. 3 is a block diagram of the portable fishing light 10. As illustrated in FIG. 3, the portable fishing light 10 may include a power unit 60, a battery voltage monitor 62, a UV LED driver 66 operably connected to the UV light source 42 (in this case a plurality of UV LEDs), and a white LED driver 66 operably connected to the white light source 44 (in this case a plurality of white LEDs). A power jack 80, illustrated in FIG. 2, enables the recharging of the power unit 60.

The portable fishing light 10 may further include a UV power toggle 78 and a white power toggle 76 (both also illustrated in FIG. 1). The power toggles enable the user to independently control the power to the light sources (between off, low, and high).

Figure 4:
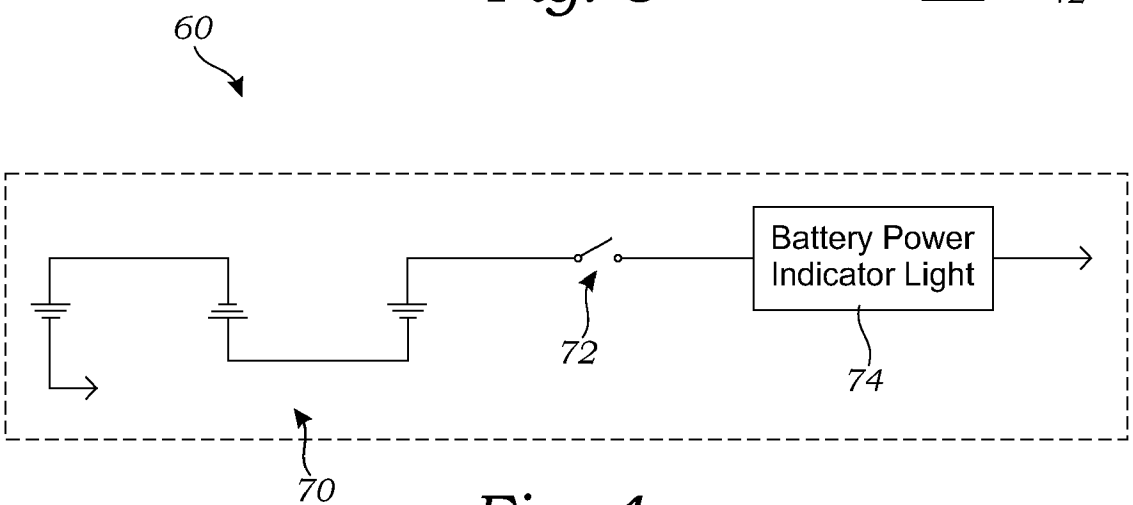
FIG. 4 is a block diagram of a power unit of the portable fishing light.

FIG. 4 is a block diagram of one embodiment of the power unit 60. As illustrated in FIG. 4, the power unit 60 may include a plurality of batteries 70 and a switch 72 for operably controlling the function of the portable fishing light 10. The plurality of batteries 70 may include, for example, D-sized NiM cell batteries, or any other power source found suitable by one skilled in the art. The switch 72, also illustrated in FIG. 1, may be any form of switch 72, or any similar or equivalent mechanism for controlling the operation of the portable fishing light 10. A battery power indicator light 74 (also illustrated in FIG. 1) may provide a visual indication that the portable fishing light 10 is powered on or off.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A portable fishing light for use on a boat, the portable fishing light comprising:

a base housing;

a mounting element adapted for removably mounting the base housing on the boat;

a light wand having a white light source and a UV light source;

a flexible control arm adjustably mounting the light wand to the base housing so that the light wand can be adjustably positioned relative to the base housing; and wherein the light wand includes opposing surfaces, wherein the white light source is mounted on one of the surfaces, and wherein the UV light source is mounted the opposing surface, so that light from the white light source is directed in a first direction, and light from the UV light source is directed in the opposing direction.

2. The portable fishing light of claim 1, wherein the mounting element includes a suction cup attached to a bottom surface of the base housing.

3. The portable fishing light of claim 2, wherein the mounting element further includes a second suction cup attached to a side surface of the base housing.

4. The portable fishing light of claim 1, wherein the base housing further includes a top surface spaced from the bottom surface with front and rear surfaces and left and right side surfaces, the top and bottom surfaces being spaced to receive a battery therebetween.

5. The portable fishing light of claim 4, wherein the top and bottom surfaces include an aperture therethrough for forming a handle for carrying the portable fishing light.

6. The portable fishing light of claim 1, further comprising a corner groove integrally molded into the base housing, the corner groove being shaped to receive the flexible control arm therein.

7. The portable fishing light of claim 1, further comprising a pair of locking arms extending from the base housing, the pair of locking arms being adapted to receive the light wand therebetween and frictionally engage the light wand to hold the light wand in the stowed position.

8. A portable fishing light for use on a boat, the portable fishing light comprising:

a base housing having a top surface and an opposed bottom surface;

a battery mounted within the base housing between the opposed top and bottom surfaces;

a mounting element adapted for removably mounting the base housing on the boat;

a light wand having opposing surfaces;

a white light source mounted on one of the opposing surfaces;

a UV light source mounted on the other of the opposing surfaces;

a flexible control arm adjustably mounting the light wand to the base housing so that the light wand can be moved between a stowed position and an extended position, wherein the light wand may be adjustably positioned relative to the base housing while in the extended position; and a pair of locking arms extending from the base housing, the pair of locking arms being adapted to receive the light wand therebetween and frictionally engage the light wand to hold the light wand in the stowed position.

9. The portable fishing light of claim 8, wherein the mounting element includes a suction cup attached to a bottom surface of the base housing.

10. The portable fishing light of claim 9, wherein the mounting element further includes a second suction cup attached to a side surface of the base housing.

11. The portable fishing light of claim 8, wherein the base housing further includes a top surface spaced from the bottom surface with front and rear surfaces and left and right side surfaces, the top and bottom surfaces being spaced to receive a battery therebetween.

12. The portable fishing light of claim 11, wherein the top and bottom surfaces include an aperture therethrough for forming a handle for carrying the portable fishing light.

13. The portable fishing light of claim 8, wherein the flexible control arm includes a flexible conduit that can bend to a desired position and then maintain that position while upholding the light wand thereupon.

14. The portable fishing light of claim 8, further comprising a corner groove integrally molded into the base housing, the corner groove being shaped to receive the flexible control arm therein.

15. A portable fishing light for use on a boat, the portable fishing light comprising:

a base housing;

a mounting element adapted for removably mounting the base housing on the boat;

a light wand having a white light source and a UV light source;

a flexible control arm adjustably mounting the light wand to the base housing so that the light wand can be adjustably positioned relative to the base housing; and wherein the flexible control arm includes a flexible conduit that can bend to a desired position and then maintain that position while upholding the light wand thereupon.

* * * * *